United States Patent [19]

Han

[11] Patent Number: 4,560,153

[45] Date of Patent: Dec. 24, 1985

[54] FIXING TOOL FOR SQUARE FRAME

[76] Inventor: David C. Han, Fl. 7, No. 325, Fu-Hsing North Rd., Taipei, Taiwan

[21] Appl. No.: 602,467

[22] Filed: Apr. 20, 1984

[51] Int. Cl.[4] ..... B25B 1/20

[52] U.S. Cl. ..... 269/42; 269/108

[58] Field of Search ..... 269/41, 42, 108, 130–132, 269/115

[56] References Cited

U.S. PATENT DOCUMENTS

| | | | |
|---|---|---|---|
| 1,053,556 | 2/1913 | Bergstrom | 269/108 |
| 4,047,710 | 9/1977 | Wilson | 269/42 |
| 4,171,799 | 10/1979 | Elko | 269/42 |

FOREIGN PATENT DOCUMENTS

| | | | |
|---|---|---|---|
| 424459 | 8/1947 | Italy | 269/108 |
| 4636 | of 1902 | United Kingdom | 269/108 |

*Primary Examiner*—Robert C. Watson

*Attorney, Agent, or Firm*—Lowe King Price & Becker

[57] ABSTRACT

The present invention relates to a fixing tool for a square frame and, more particularly to one utilizing three molds and a base mold to support four corners of a square frame, with a rope or metal strip passing through the outer periphery of the molds and then clamping the rope or metal strip with a fixing piece, so that when the fixing piece is drawn by screwing a screw handle against the base mold, the corners of the square frame can be clamped by means of the molds and the base mold to thereby facilitate correctly positioned adhesion of the square frame.

1 Claim, 3 Drawing Figures

FIXING TOOL FOR SQUARE FRAME

BACKGROUND OF THE INVENTION

There are many objects, such as a picture frame, a window frame etc., which are constructed with a generally square frame structure. One of the conventional methods of manufacturing such square frames is, for example, to produce four pieces of frame woods, each of which is cut at 45° at both ends in, order to form a square frame successively, and then to miter these frame sides with iron nails or adhesive so as to form a square frame by forming miter joints. However, the drying of the adhesive takes additional time such that if the square frame is inadvertently tampered with during the drying of the adhesive, it usually causes crookedness or inadequate positioning of the square frame. Moreover, when coupling of these frame joints is accomplished by means of iron nails, errors cause waste of time and it is difficult to connect these frame sides to the adequate positions respectively.

Accordingly, in view of these disadvantages and inconveniences described above, the inventor of the present invention, after research and experiment, has invented a fixing tool for a square frame.

SUMMARY

The present invention relates to a fixing tool for square frame and, more particularly to one utilizing three molds and a base molds to support four corners of a square frame, with a rope or metal strip passing through the outer periphery of the molds and clamping the rope or metal strip with a fixing piece. Thus, when the fixing piece is drawn by screwing a handle against the base mold, the corners of the square frame can be clamped by means of the molds and the base mold to thereby facilitate the adhesion of the square frame. The inner perimeter of each of the molds and the base mold take the form of right angle and the outer periphery of each of these molds is substantially in arc form. The major object of the present invention is to provide a fixing tool for a square frame, which utilizes three molds and a base mold to support the four corners of a square frame. The inner perimeter of these molds and the base mold are in the form of right angle and the outer periphery of each of these molds has an arc form such that the corners of the square frame can be positively clamped when the inner perimeters of these molds and the base mold are supported against the corners of the square frame by passing a rope or metal strip through the outer periphery of these molds to thereby facilitate the adhesion of the square frame.

Another object of the present invention is to provide a fixing tool for a square frame wherein the four corners of the square frame are clamped simultaneously by passing a rope or metal strip through the outer periphery of the molds of the fixing tool. The rope or metal strip is secured on a fixing piece which is activated by a screw handle such that these molds can be clamped by screwing the screw handle against the base mold.

Yet another object of the present invention is to provide a fixing tool for a square frame which utilizes the combination of simple components to avoid the disadvantages found in the prior art, such that it can be economically accomplished by means of inherent features of the invention described herein.

DETAILED DESCRIPTION OF THE PREFERRED EMBODIMENT

Figures 1A, 1B:
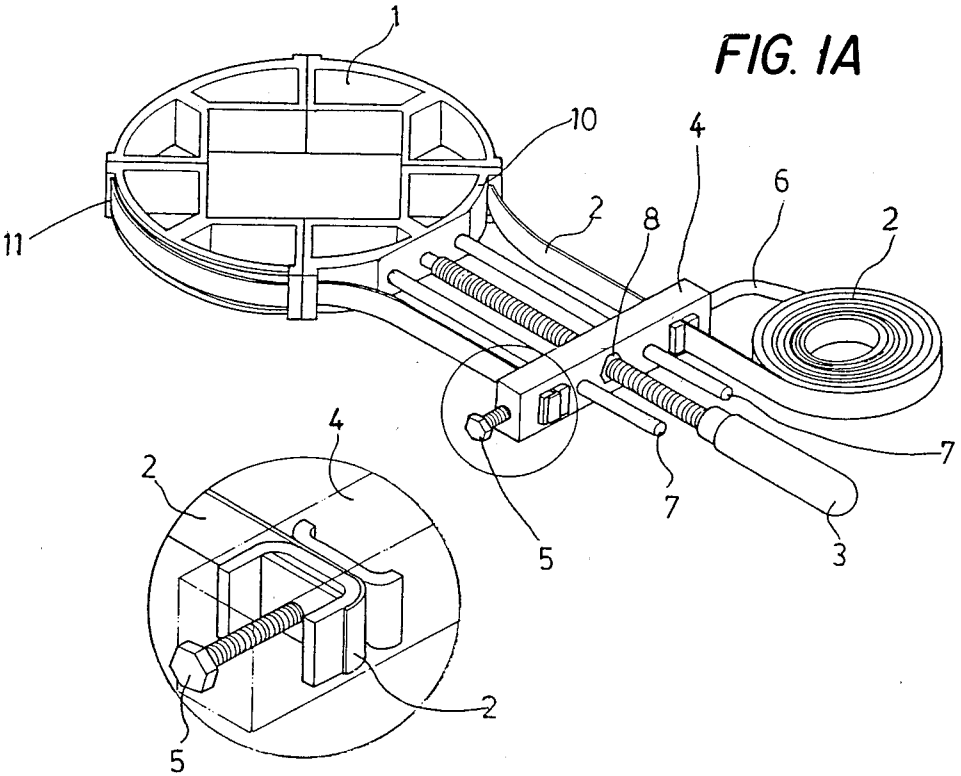
FIGS. 1A and 1B are, respectively, a perspective view of the preferred embodiment according to the present invention, showing the fixing tool for a square frame in retracted position and a detailed view of the fixed end of the metal strip.

Referring now to FIG. 1A, the fixing tool of the present invention comprises three molds (1), a base mold (10), a fixing piece (4), a rope or metal strip (2) and a screw handle (3). The inner perimeter of each of the molds (1) is substantially in the form of right angle and the outer periphery of which takes an arc form. Also, the inner perimeter of the base mold (10) is substantially in the form of right angle. Each of the molds (1) and the base mold (10) is provided with two flanges (11), each of which forms a slot (12) on both the ends of the outer periphery of each of the molds (1) and the base mold (10), such that the rope or metal strip (2) may pass through these slots (12) to thereby tightly clamp together the molds (1) and the base mold (10). The outer periphery of the base mold (10) is substantially in arc form except that a plane zone is provided on the central part thereof. Two guide rods (7) are connected to the plane zone of the base mold (10). The fixing piece (4) is provided with three holes and a hexgonal nut (8) is mounted within the central one of these holes. The screw handle (3) is passed through the central hole of the fixing piece (4) and is threadedly engaged with the hexgonal nut (8). The guide rods (7) are slidably passed through the outer holes of the fixing piece (4) respectively, such that when one end of the screw handle (3) is supported against the plane zone of the outer surface of the base mold (10), the fixing piece (4) can be stably activated back and forth by screwing the screw handle (3). As best illustrated in FIGS. 1A and 1B, the fixing piece (4) is further provided with two fixing means for fixing the rope or metal strip (2). One end of the rope or metal strip (2) is securely fixed by screwing a fixing bolt (5) of the fixing means against the rope or metal strip (2). The other end of the rope or metal strip (2), after passing through all the slots (12) of the molds (1) and (10), is adjustably fixed by a fixing handle (6) of the other fixing means, such that the length of the rope or metal strip (2) encircles the outer periphery of the molds (1) and (10), i.e., tension resulting from the fact that the rope or metal strip (2) clamps all the molds (1) and (10), can be adjusted by such fixing means.

Figure 2:
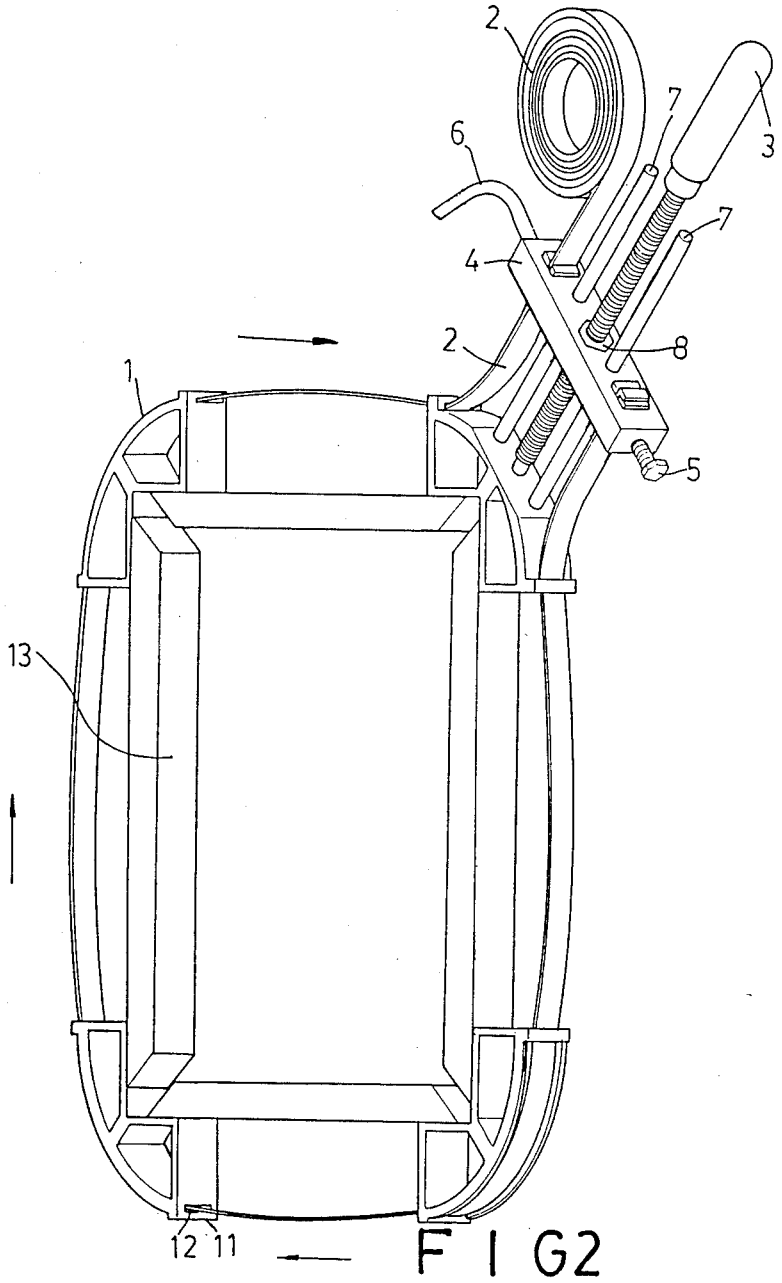
FIG. 2 is a perspective view, showing four frame sides enclosed within the confines of the molds and the base mold of the present invention.
Figure 3:
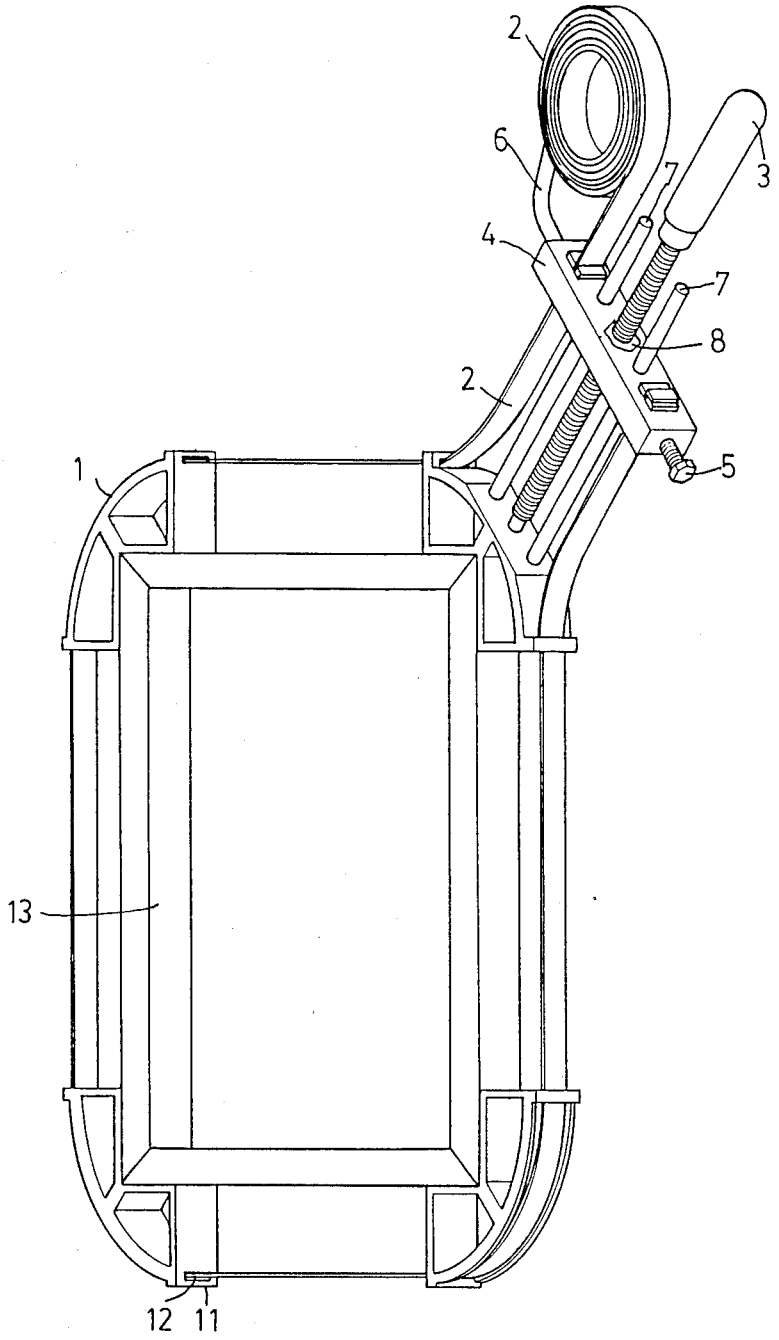
FIG. 3 is a perspective view, showing a square frame comprising four frame sides clamped by means of activation of the molds and the screw handle of the present invention.

Referring now to FIGS. 2 and 3, as the frame sides (13) are going to constitute a square frame, the rope or metal strip (2) is firstly loosened by means of activation of the fixing handle (6) such that the molds (1) can be slided within the confines of the rope or metal strip (2). The frame sides (13) then are positioned within the confines of the rope or metal strip (2) with the four corners of the frame woods (13) mating with the inner perimeters of the molds (1) and the base mold (10) correspondingly. Consequently, when the rope or metal strip (2) is retracted along the direction of the arrow shown in FIG. 2 to the extent of having proper tension, it is fixed by screwing the fixing handle (6) of the fixing piece (4). Then the frame woods (13) are clamped tightly by screwing the screw handle (3) against the base mold (10) to thereby facilitate affixation of the frame sides (13) to constitute a square frame.

I claim:

1. A fixing tool for a square frame comprising:

three molds, each having an inner perimeter in the form of a right angle, an outer periphery in the form of an arc, and provided at each end with a slotted flange;

a base mold, having an inner perimeter adapted to cooperate with the inner perimeters of said molds to enclose a square, said base mold having an outer periphery in the form of an arc with a plane zone provided on a central part thereof;

two parallel guide rods, each connected normal to said plane zone of said base mold;

a fixing piece, slidably guided by said two guide rods so that said fixing piece can make contact with the plane zone of said base frame;

a rope, a first end of which is secured to one end of said fixing piece and a second end of which is passed through another end of said fixing piece; and a screw handle, threadedly engaged with said fixing piece and having one end supported against said base mold.

* * * * *